US008082986B2

(12) United States Patent
Heidenreich et al.

(10) Patent No.: US 8,082,986 B2
(45) Date of Patent: Dec. 27, 2011

(54) FILTERING DEVICE, ESPECIALLY FOR USE AS A WELL SCREEN FILTER

(75) Inventors: Steffen Heidenreich, Stimpfach (DE); Astrid Walch, Kressberg (DE); Martin Bergmann, Wunsiedel (DE)

(73) Assignee: Pall Corporation, Port Washington, NY (US)

( * ) Notice: Subject to any disclaimer, the term of this patent is extended or adjusted under 35 U.S.C. 154(b) by 169 days.

(21) Appl. No.: 12/516,405

(22) PCT Filed: Dec. 4, 2007

(86) PCT No.: PCT/EP2007/010521

§ 371 (c)(1),
(2), (4) Date: May 27, 2009

(87) PCT Pub. No.: WO2008/067990

PCT Pub. Date: Jun. 12, 2008

(65) Prior Publication Data

US 2010/0065270 A1 Mar. 18, 2010

Related U.S. Application Data

(60) Provisional application No. 60/868,372, filed on Dec. 4, 2006.

(51) Int. Cl.
*E21B 43/08* (2006.01)

(52) U.S. Cl. ..... 166/228; 166/233; 166/235; 166/236; 166/276

(58) Field of Classification Search ..... 166/228, 166/236, 233, 235, 276
See application file for complete search history.

(56) References Cited

U.S. PATENT DOCUMENTS

| | | | | |
|---|---|---|---|---|
| 3,556,304 | A * | 1/1971 | Collard et al. | 210/489 |
| 4,378,294 | A * | 3/1983 | Wagner et al. | 210/460 |
| 4,754,807 | A * | 7/1988 | Lange | 166/236 |
| 5,246,158 | A * | 9/1993 | Nagaoka et al. | 228/175 |
| 5,318,119 | A * | 6/1994 | Lowry et al. | 166/228 |
| 5,787,980 | A * | 8/1998 | Sparlin et al. | 166/231 |

(Continued)

FOREIGN PATENT DOCUMENTS

| | | |
|---|---|---|
| DE | 20 2005 002 870 | 6/2005 |
| EP | 1 101 873 | 5/2001 |
| EP | 1 803 893 | 7/2007 |

(Continued)

OTHER PUBLICATIONS

SCHUMASOIL®, High Density Porous Polyethylene Well Screen, U.S. Filter/Johnson Screens, 11 pages, not dated.

*Primary Examiner* — Giovanna Wright
(74) *Attorney, Agent, or Firm* — Leydig, Voit & Mayer, Ltd.

(57) ABSTRACT

The present invention relates to filtering device which is especially designed for use as a well screen filter. The filtering device comprises a tubular supporting element (12) and two or more tubular segments (14) of a porous filter medium arranged in axial alignment to one another and concentrically and essentially coextensive with the tubular supporting element (12), said tubular supporting element (12) having a tubular wall provided with a plurality of perforations (26, 28, 30) and having a plurality of projections projecting from said tubular wall, said projections supporting the two or more tubular segments in axial alignment with the tubular wall, said tubular segments each having two end portions which are in sealing contact with the tubular supporting element or an end portion of another tubular segment.

20 Claims, 10 Drawing Sheets

U.S. PATENT DOCUMENTS

| | | | | |
|---|---|---|---|---|
| 6,390,192 | B2 * | 5/2002 | Doesburg et al. | 166/230 |
| 2001/0003313 | A1 | 6/2001 | Doesburg et al. | |
| 2004/0084177 | A1 | 5/2004 | Wang et al. | |
| 2007/0108112 | A1 * | 5/2007 | Jones et al. | 210/170.11 |
| 2008/0093123 | A1 | 4/2008 | Pinto Bascompte | |

FOREIGN PATENT DOCUMENTS

| | | |
|---|---|---|
| FR | 607 521 | 7/1926 |
| WO | WO 03/091537 | 11/2003 |
| WO | WO 2005/059308 | 6/2005 |
| WO | WO 2006/045859 | 5/2006 |

* cited by examiner

FILTERING DEVICE, ESPECIALLY FOR USE AS A WELL SCREEN FILTER

BACKGROUND OF THE INVENTION

The present invention relates to a filtering device which is especially designed for use as a well screen filter.

Well bores generally are either vertical or horizontal. Vertical well bores are more commonly known, but in certain applications horizontal wells have several advantages. Especially, horizontal wells may be easily designed with a length of several hundred meters and much more and therefore allow for very large filtering areas.

Details of this horizontal well technology as well as the problems associated therewith may be learned from US 2001/0003313 A1 which is incorporated in its entirety herein by reference.

This reference also describes the problems associated with vertical wells so that again reference may be made to this US patent application for further details of the prior art.

One problem encountered with horizontal as well as the vertical wells originates from the large dimensions of the filtering devices needed. They have to withstand large stresses in axial direction. While conventional filter media used for well screen filters may have a tensile strength of 1 metric ton or somewhat more, which is sufficient to maintain integrity of the filter media once the well screen filter is in place, larger well projects require a tensile strength of 20 metric tons or even more for safe handling of the filtering device during the period of manufacture and especially transporting and positioning of the filtering device within the well bore. In order to cope with such large mechanical forces, use of a tubular casing for the filtering device is required to provide for the necessary tensile strength which, after deposition of the filtering device in the well bore, has to be removed.

However, manufacturing of the casing, positioning of the casing and removing the casing from the well bore requires substantial additional time during which the well drilling equipment is still needed, which causes a substantial increase in costs.

For example, the providing of a horizontal well bore of 300 m length with a filtering device requires approximately one week. If the well bore extends to approximately 15 km, it takes a complete year to provide the well bore with the corresponding filtering device.

The object of the present invention is to provide a filtering device which may be positioned in the well bore with lower costs and which may be easily manufactured and transported to the site of the well bore.

BRIEF SUMMARY OF THE INVENTION

This object is solved by a filtering device according to claim 1.

Because of the use of a tubular supporting element providing sufficient tensile strength for the whole filtering device, a casing to protect the filtering device during transportation and positioning is no longer needed and the porous filter medium may be designed in a manner to optimize its filtering characteristics.

At the same time, since the tubular supporting element and the tubular segments of a porous filter medium provide an entity which is positioned together in the bore and remains there during all of the operation of the filtering device, a part of the previous procedure for positioning the filtering device in the well bore, namely removal of a tubular casing, is not needed and the required positioning time may be cut to approximately half of the time or even less.

In view of the time required to position the filtering devices in bore holes of several hundred meter length, a substantive saving in costs can be achieved.

The supporting element having a tubular wall provided with a plurality of perforations and having a plurality of projections extending beyond that tubular wall safely accommodates the tubular segments of porous filter medium although it does not hinder fluid flow through the filter medium of the filtering device.

The perforations provided in the tubular wall of the tubular supporting element are designed to provide an essentially unhindered fluid flow to or from the porous filter medium.

Because of this, the porosity of the filter medium is the one parameter which governs the fluid flow through the filtering device. The perforations of the tubular wall of the tubular supporting element are designed to not affect the $\Delta p$ over the filtering device, such that the $\Delta p$ is essentially governed by the nature and the characteristic of the porous filter medium only.

Since the filtering devices according to the present invention are mostly used in well bores which have a substantially circular cross section, the tubular supporting element and/or the tubular segments of porous filter medium advantageously also have an essentially circular cross section.

In a preferred embodiment the tubular segments of porous filter medium comprise a porous tubular wall of sintered particulate polymer material. For many applications, the polymer material preferably comprises a polyethylene, more preferably a HDPE. Such sintered material may have a tensile strength in axial direction of 1 metric ton or more.

Likewise, the tubular wall of the supporting element may be made of polymer material, however, in this case, it is not a sintered porous material, but a non-porous extruded or molded material in order to provide the supporting element with enough tensile strength of, e.g., 20 metric tons or more.

The tubular porous segments may be positioned inside the tubular supporting element or on the outer circumferential surface of the tubular supporting element.

Positioning of the tubular supporting element inside the porous tubular segments is preferable since this arrangement maximizes the filter area available in a given well bore. In this alternative it allows for smaller bore hole diameters which reduces the costs for drilling the well bore. It has been found out that the tubular supporting element when positioned within the tubular segments of porous filter medium does not noticeably affect fluid flow within the usual flow rate ranges typical for well screen applications.

However, in certain circumstances, especially when specific applications require mechanical protection of the porous filter medium, the porous tubular segments may be positioned within the tubular supporting element, the tubular supporting element providing both tensile strength and permanent protection against mechanical impact in radial directions for the filter medium.

The perforations of the tubular wall of the supporting element are designed such that in case the tubular wall is encasing the filter medium, no blockage of the openings of the perforations may occur by particulate matter contained in inflowing of non-filtered fluid. In well screen applications, usually a cross sectional area of the perforations corresponding to a hole of 10 mm diameter will do, although it is understood that the cross section of the perforations need not necessarily be circular but may have various shapes.

In addition, the shape and the number of the perforations is selected such that it does not contribute to a relevant increase of $\Delta p$.

In embodiments where the supporting element is positioned within the tubular segments of porous filter medium, the afore-mentioned risk of blockage of the perforations is not existent so that the design of the openings of the perforations may be adjusted just to avoid an undue increase in op of the filtering device.

The afore-mentioned exemplary dimensions given for the openings of the perforations may likewise apply for such an embodiment.

In a preferred embodiment, the tubular supporting element comprises ring-shaped elements providing the projections extending all around the outer peripheral surface, or the inner peripheral surface where applicable, of the tubular supporting element.

Preferably, the ring-shaped elements provide a predetermined distance between the tubular wall of the supporting element and the filter medium. This provides unhindered access of the fluid to the filter medium or unhindered fluid flow from the filter medium through the tubular wall and its perforations. In the alternative, spacer elements may be used to define that distance.

Preferably, the tubular supporting element and the porous tubular segments of filter medium are connected to one another by first and second ring-shaped elements arranged adjacent to the respective ends of the porous tubular segments. In the sequence of a number of tubular segments positioned in axial alignment with the tubular supporting element, one ring-shaped element may serve for adjacent ends tubular segments, both, as a first and second ring-shaped element. Thus, there is no need to use separate ring-shaped elements for each end portion of the neighboring tubular segments where the respective ends of two tubular segments meet, but one ring-shaped element may accommodate the respective ends of both tubular segments.

In a preferred embodiment, especially when the tubular segments are positioned around the tubular supporting element, the first and second ring-shaped elements advantageously extend radially beyond the surface of the tubular segments. Thus, the ring-shaped elements provide for a sort of flange which allows to deposit the filtering device on a flat area without having the filter medium contact the ground.

This facilitates handling of the filtering devices to a great extend and at the same time protects the surface of the filter medium from mechanical damages.

In cases where relatively lengthy tubular segments are employed and/or where substantive radial forces may be exerted on the tubular sections, it may be advisable to position one or more spacers between the tubular wall and the filter medium in axial position between the first and second ring-shaped elements.

While the distance between the first and second ring-shaped elements measured in axial direction may be of from 1 to 12 m, it is preferred that the axial distance between the spacers and the first or second ring-shaped elements or neighboring further spacer is in the range of 1 to 6 m.

For sintered particulate material it is often more convenient to produce the segments in two or more tubular portions which then are bonded together to form an individual tubular segment. Especially the portions of the tubular segment may be welded together.

In one embodiment, the portions of tubular filter medium welded together to form a tubular segment comprise a weld seam at the junction of two adjacent portions which advantageously projects from the surface of the segment thereby providing a spacer to determine the distance between the tubular wall of the supporting element and the filter medium (tubular segment).

The spacers are preferably made from an elastically deformable polymer material, which provides the filtering device as a whole with more elasticity without influencing the tensile strength of the device. Elastically deformable polymer material for manufacturing the spacers include among others EPDM and FPM.

In many applications, the axial length of the inventive filtering device will be such that the tubular supporting element cannot be manufactured as a unitary structure. Then the tubular supporting element will be composed of a number of portions of, e.g., several meters length which, e.g., may be welded together to form the tubular supporting element at the site where the filtering device will be positioned in a well bore.

In the alternative to welding two portions directly together, a ring-shaped element may be designed as a structure to be placed between two axially adjacent portions of the tubular supporting element and serve to connect the portions, e.g., in a welding step.

In another preferred embodiment, the first and second ring-shaped elements are provided by a weld seam connecting two portions of the tubular supporting element. The weld seam then may generally replace the ring-shaped elements and can then at the same time function to bond two portions of the tubular supporting element together and support the porous segments.

In many applications, manufacturing of the supporting element will be made by providing a number of portions of the supporting element and welding these portions together. This measure not only facilitates manufacturing of the supporting element, but also simplifies transportation of the filtering device to the site where the well screen is needed. Furthermore, this measure allows manufacturing of filtering devices of any desired length using standardized constructional elements.

In a further embodiment of the present invention, the filtering device comprises a plurality of tie elements, especially tie rods or tie ropes positioned remote from the axis of the filtering device in predefined distances to one another and parallel to the axial direction of the filtering device. The tie rods or tie ropes allow further adaptation of the stress resistance of the inventive filtering device without putting undue limitations on the selection and construction of the filter medium and/or supporting element.

Thus, by use of the plurality of tie rods or tie ropes, these constructional elements can be designed to provide for a substantive part of the tensile strength of the filtering device such that the construction of other portions of the filtering device may take into account other desired characteristics without having need to at the same time provide improvement of the tensile strength of the filtering device as a whole.

In one embodiment, the tie rods or tie ropes are fixed at their respective end portions in first and second ring-shaped elements. These first and second ring-shaped elements therefore provide an anchoring function for these tie rods and tie ropes.

The tie rods or tie ropes are preferably positioned in a distance to one another of 2 mm or more, thus leaving enough space in between them to not disturb the function of the filtering device, wherever the tie rods or tie ropes may be positioned within the device.

Indeed, there are different possibilities to position the tie rods and tie ropes within the filtering device. One possibility is to accommodate the tie rods or tie ropes within the porous cylindrical wall of filter medium.

An alternative to such a positioning is to accommodate the tie rods or tie ropes in between the tubular supporting element and the filter medium as shown in FIGS. 8 and 9 showing tie rods 60. They may then serve as spacers. In a still further alternative, the tie rods or tie ropes may be accommodated in the tubular wall of the supporting element as shown in FIG. 10 showing tie rods 60.

In still a different embodiment of the present invention, the supporting element itself may be in the form of a cage of a plurality of parallel tie rods. The tie rods of the supporting element may be in bodily contact with the filter medium, since the spaced apart tie rods provide large areas of access to the filter medium even when they abut the filter medium.

In many cases, it is advisable to manufacture the tie rods or tie ropes of plastic material, wherein especially a non-porous plastic material will be used which advantageously may be reinforced.

Alternatively to the use of tie rods or tie ropes or in addition thereto the plastic material of the supporting element and optionally the filter media may be reinforced to further increase the tensile strength.

In addition, the ring-shaped elements are preferably made of reinforced plastic material, especially when they serve as anchoring means for tie rods or tie ropes.

Finally, for the manufacture of the tie rods or tie ropes reinforced plastic material may advantageously be used.

For reinforcement, a broad scope of material may be used including, but not limited to organic or inorganic filler materials including organic or inorganic fibers like aramid fibers, glass fibers, carbon fibers or metal fibers. The fibers may be short fibers with a length up to 3 mm or long fibers with a length of, e.g., 5 to 10 mm in the average or endless fibers may be used.

In view of the fact that the supporting element as well as the tie rods or tie ropes are designed to take up stress mainly in axial direction, orientation of fibers reinforcing the plastic material along the axial direction is highly recommended since then a maximum advantage of the reinforcing fiber materials may be obtained.

In the alternative, the tie rods or tie ropes may be made of metal material. The tie ropes may comprise a bundle of endless filaments which may not only be metal filaments, but also plastic material filaments, carbon fibers, glass fibers, ceramic fibers, etc. which may be optionally bonded together by a binder material to facilitate handling of the same.

One of the most prominent uses for the inventive filtering device is the use as a well screen filtering device. In view of the extremely high length which can be needed for horizontal well screen filters, the present invention is especially useful as a horizontal well screen filtering device since it can be readily made up to a nearly unlimited number of portions of the supporting element and tubular porous sections so as to meet any need for a certain length of the well screen filter.

Similarly, the inventive filtering device may be used as a seawater intake device which is often also positioned in an horizontal well bore and may then serve for generation of drinking water, for the generation of fish farming water or the generation of cooling water.

The use directed to the generation of drinking water may frequently include desalination in a step following filtration.

A further use of the filtering device according to the present invention is that for soil drainage.

A still further use of the inventive filtering device is that of removal of subsurface contaminations. Also in the latter two applications, the well bore will most often be a horizontal one.

These and further advantages of the present invention will be shown and described in connection with the attached Figures.

DETAILED DESCRIPTION OF THE INVENTION

Figure 1:
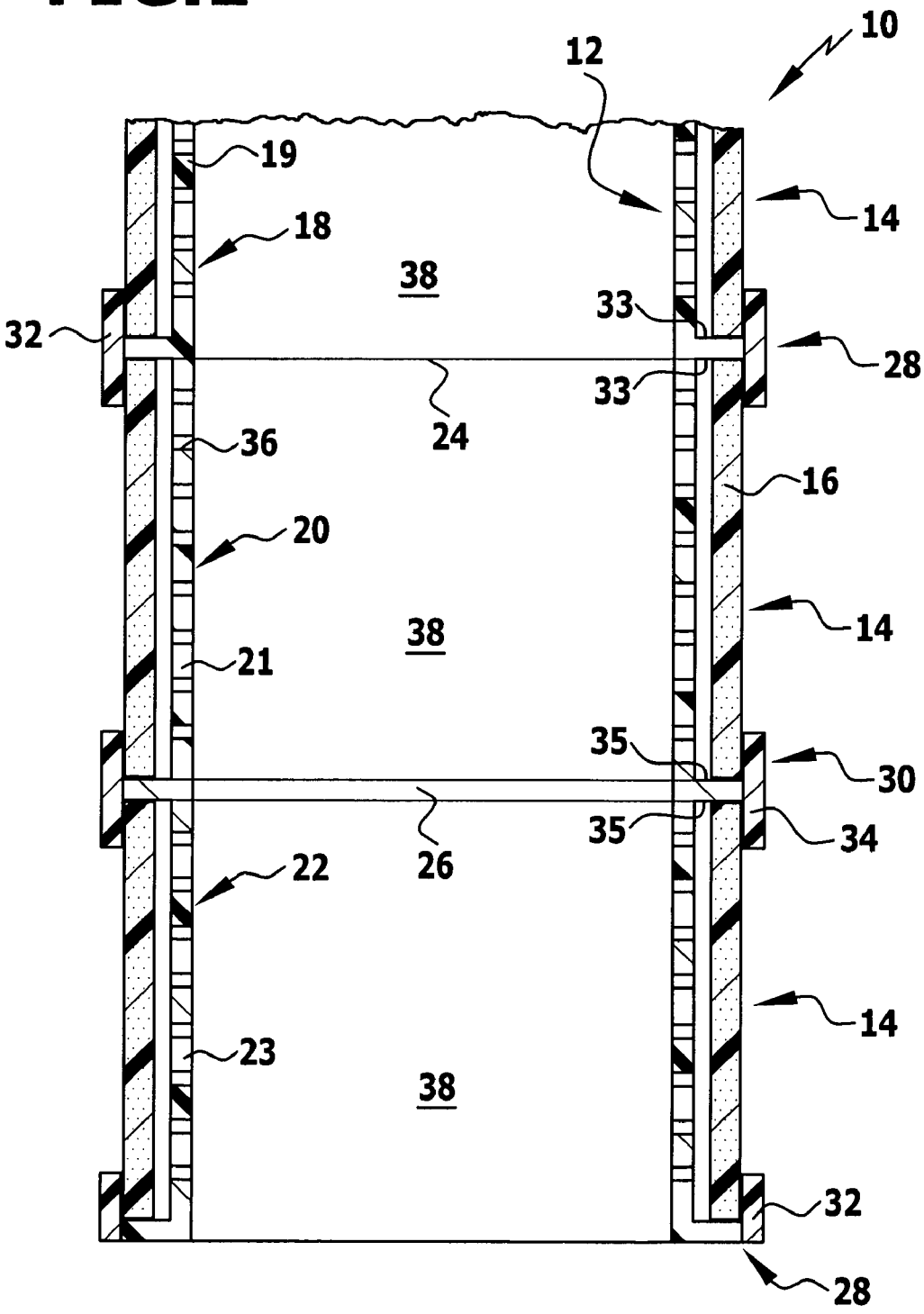
FIG. 1: A schematic representation of an inventive filtering device.

FIG. 1 shows a schematic representation of an inventive filtering device 10 comprising a supporting element 12 and a plurality of tubular segments 14 of a porous filter medium 16. The supporting element 12 is positioned concentrically within the tubular segments which are coaxially aligned with the tubular supporting element 12.

The supporting element 12 is made of several portions 18, 20 and 22 which are aligned and bonded to one another to form an integral supporting element 12.

Bonding of two adjacent portions of the supporting element may be effected in different ways and two of them are exemplified in FIG. 1.

Of course, in a real filtering device usually only one method of bonding the portions 18, 20, 22 of the supporting element 12 together will be put into practice other than represented in FIG. 1.

In FIG. 1, the portions 18 and 20 are bonded together directly by a weld seam 24 which may be effected by any suitable conventional welding technique.

In order to give another example for bonding two portions of the supporting element together, FIG. 1 shows portions 20 and 22 fitted together by an intermediate ring-shaped element 26 which is bonded to both of the portions 20 and 22 on opposite axial faces thereof. Again, any conventional suitable welding or bonding technique may be used to effect the bond between the ring-shaped element 26 and the portions 20 and 22.

The tubular supporting element is provided with radially extending projections 28, 30 which again are of a different structure only for the purpose to show different possibilities but will usually be uniform throughout one supporting element 12.

The portions 18 and 22 of supporting element 12 comprise a cylindrical (tubular) wall 19 and 23, respectively, and carry on their lower portion a projection 28 radially extending outwards from the tubular walls 19 and 23. Thus, it is possible to fit each one of the portions 18 and 22 of the supporting element 12 with a tubular segment 14 of a filter medium 16 prior to assembly of the portions to an integral supporting element 12.

Portion 20 of the support element 12 essentially consists of a tubular wall 21 only which does not carry any projections.

Once the portions 18 and 20 are welded together at weld seam 24, the tubular segments 14 are fixed in axial direction on the tubular supporting element portions and hold in place.

The projections may alternatively be provided by the ring-shaped element 26 which radially extends from the wall portions 21 and 23 beyond their outer circumferential surface in order to support a corresponding tubular segment 14 of porous filter medium 16.

In order to provide a fluid tight bond at the respective end portions of each tubular segment to the supporting element, a sealing ring 32 may be welded to projection 28 which likewise provides a fluid tight seal between the body of the supporting element 12 and the tubular segment 14. Reference numeral 33 of FIG. 1 points to another possible seal area but does not show it in detail for the sake of simplicity.

In case of the use of a ring-shaped element 26, in order to bond two portions 20 and 22 of the supporting element 12 together, the ring-shaped element may include already a flange structure 34 which may likewise be used to seal the tubular segments 14 to the supporting element 12 in a fluid tight manner. An alternative point to seal is marked with reference numeral 35.

Alternatively, the ring-shaped element 26 may be provided without the circumferential vertical flange 34 which may later on be applied in the same manner as the sealing ring 32 described in connection with the bonding of the supporting element 12 to tubular segments 14 at the junctions of portions 18 and 20.

The same comment applies to the bonding of the tubular segment 14 to the lower end of portion 22 of the supporting element and its projection 28. Again, a sealing ring 32 may provide for the seal between the tubular segment 14 and the supporting element 12, i.e., the lower end of portion 22 of supporting element 12.

If the supporting element 12 ends with portion 22, of course the projection 28 could here integrally include an upstanding ring flange to provide for the sealing ring.

The supporting element 12 is provided in its wall portions 19, 21 and 23 with perforations in the form of throughholes 36 which may have a circular cross section or any other cross sectional shape provided, they provide a more or less unhindered fluid flow from the filter medium 16 to the interior volume 38 of the supporting element 12. Furthermore, the perforations have to be designed and positioned such that the tensile strength of the supporting element is maintained as much as possible.

For example, a cross sectional area of throughhole 36 with a diameter of approximately 10 mm will be sufficient to this end. The throughholes 36 will preferably be positioned along a helical line on the surface of the walls 19, 21 and 23.

Of course, elongated throughholes or perforations 36 may likewise be used and they may be oriented in longitudinal direction, i.e., parallel to the axis of the filtering device 10 for the sake of conserving a maximum of tensile strength.

To that effect the material selected for manufacturing the supporting element 12 and its portions 18, 20 and 22, respectively, is selected such that the tensile strength required for the filtering device 10 is essentially provided by the supporting element 12 alone.

In this cases, the filtering material 16 may be designed for the specific filtration task and one need not pay too much attention to the tensile strength of the material although the material of course must withstand the pressure differential occurring during the filtration operation, the handling during manufacturing, transportation and positioning of the filtering device.

Usually, a material of sintered particulate matter, especially HDPE particulate matter, will provide satisfying results, e.g., a tensile strength of approximately 1 metric ton or somewhat more. Those materials have proven to have sufficient mechanical stability.

The porosity of the filter medium 16 may vary to some extend but typically will be in the range of 5 to 3.000 micrometers.

Spacers may provide for a predefined distance between the circumferential surface of the supporting element 12 and its portions 18, 20 and 22, respectively and the inner circumferential surface of the tubular segments 14 (not shown in FIG. 1).

Figure 2:
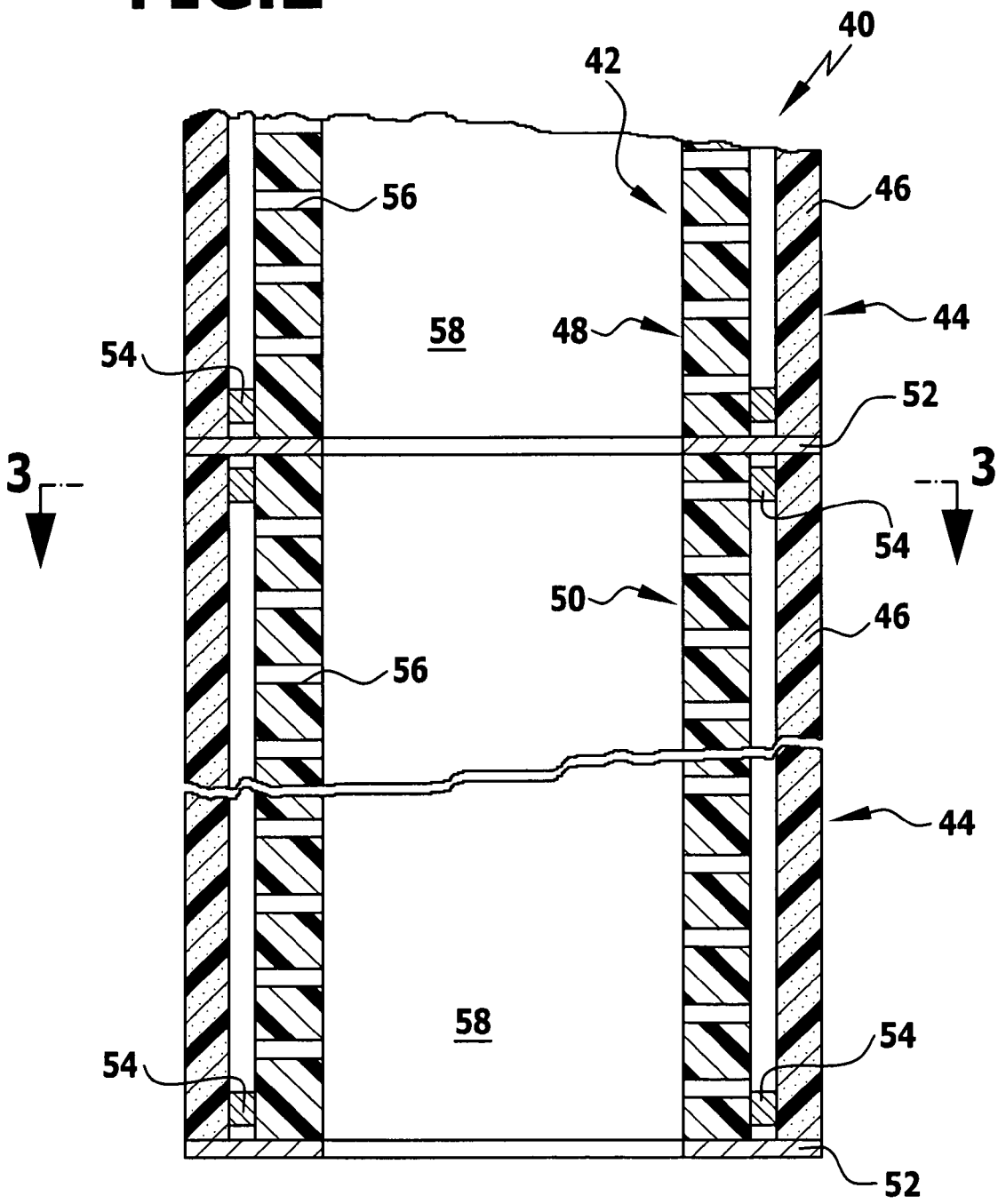
FIG. 2: a detailed cross sectional representation of an embodiment of an inventive filtering device.

FIG. 2 shows another embodiment of an inventive filtering device 40 comprising a supporting element 42 which supports on its outer peripheral surface tubular segments 44 of a filter medium 46. The supporting element 44 is comprised of a plurality of portions 48 and 50 which are bonded together by ring-shaped elements 52 which provide the function of projections to support the tubular segments 44 in axial alignment with the tubular wall of supporting element 42.

The structure of the portions 48 and 50 as well as of the tubular segments 44 as shown in FIG. 2 is rather simple and essentially consists of a tubular structure only.

The end portions of the tubular segments 44 are bonded to the ring-shaped elements 52 in a sealingly manner in order to prevent any bypass for a fluid flowing from the exterior of the filtering device to the inner volume 58.

In order to adjust the distance between the outer circumferential surface of supporting element 42 and the inner circumferential surface of the tubular segments 44, spacer rings 54 are used which may be shrink fitted on the outer circumferential surface of the portions 48 and 50 of the supporting element 42. In the alternative, the spacer rings 54 can also be welded to the outer surface or bonded in any other conceivable manner.

The tubular segments 44 may be manufactured as a unitary structure. Depending on the axial length of the segments 44 it may be advantageous to manufacture them from a number of portions of tubular filter medium which are axially aligned and then welded together to form one of the tubular segments 44. In such a configuration, the weld seams joining the portions of tubular filter medium can be designed to form spacer rings 54 and define the distance between the supporting element 42 and the segment 44. Separate, additional spacer rings 54 may then not be needed.

The portions 48 and 50 comprise in the tubular wall portions perforations 56, the dimensions of which as well as their number are designed to provide essentially unhindered access to the filtering medium 46 and to provide unhindered drainage of fluid entering from the outside of the filtering device 40 into the inner volume 58 of the filtering device 40 within the two portions 48 and 50.

Figure 3:
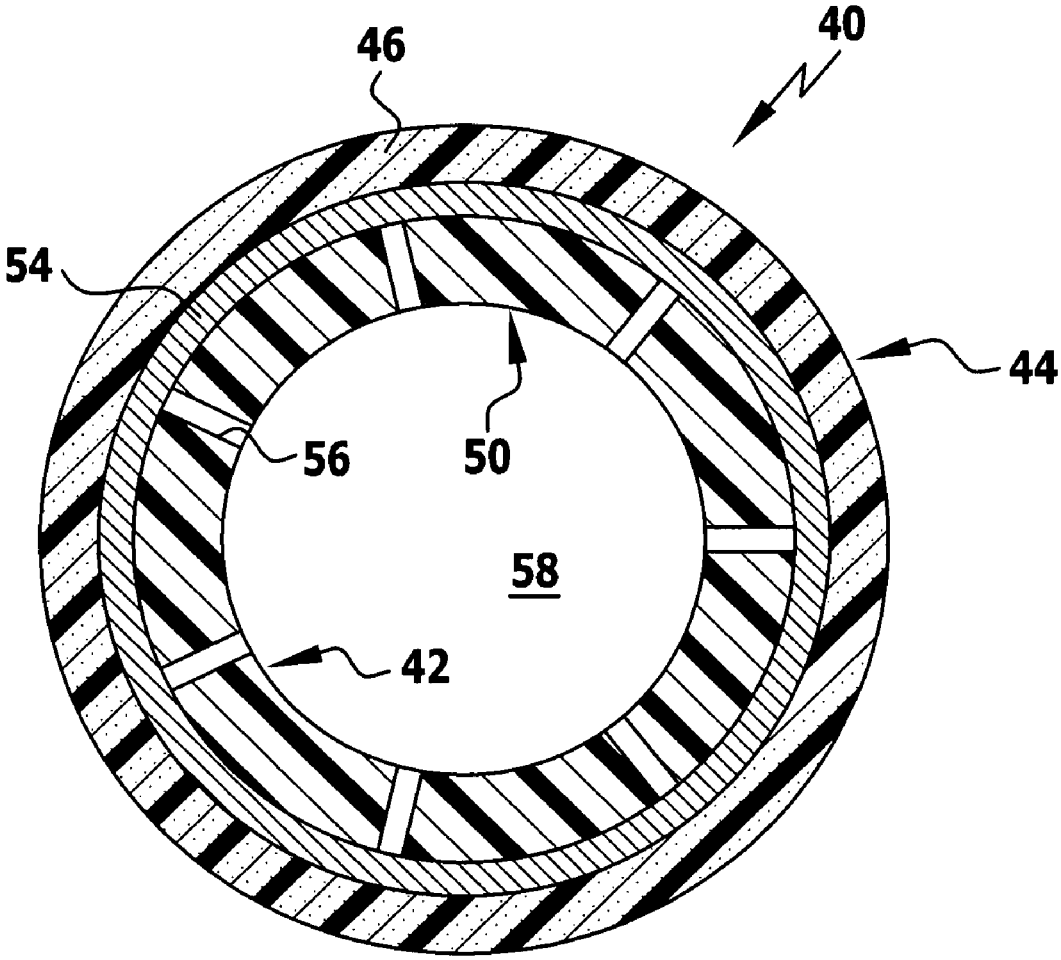
FIG. 3: a cross sectional representation of the filtering device of FIG. 2 along lines 3-3.

FIG. 3 shows a circular cross section along line 3-3 in FIG. 2.

Figure 4:
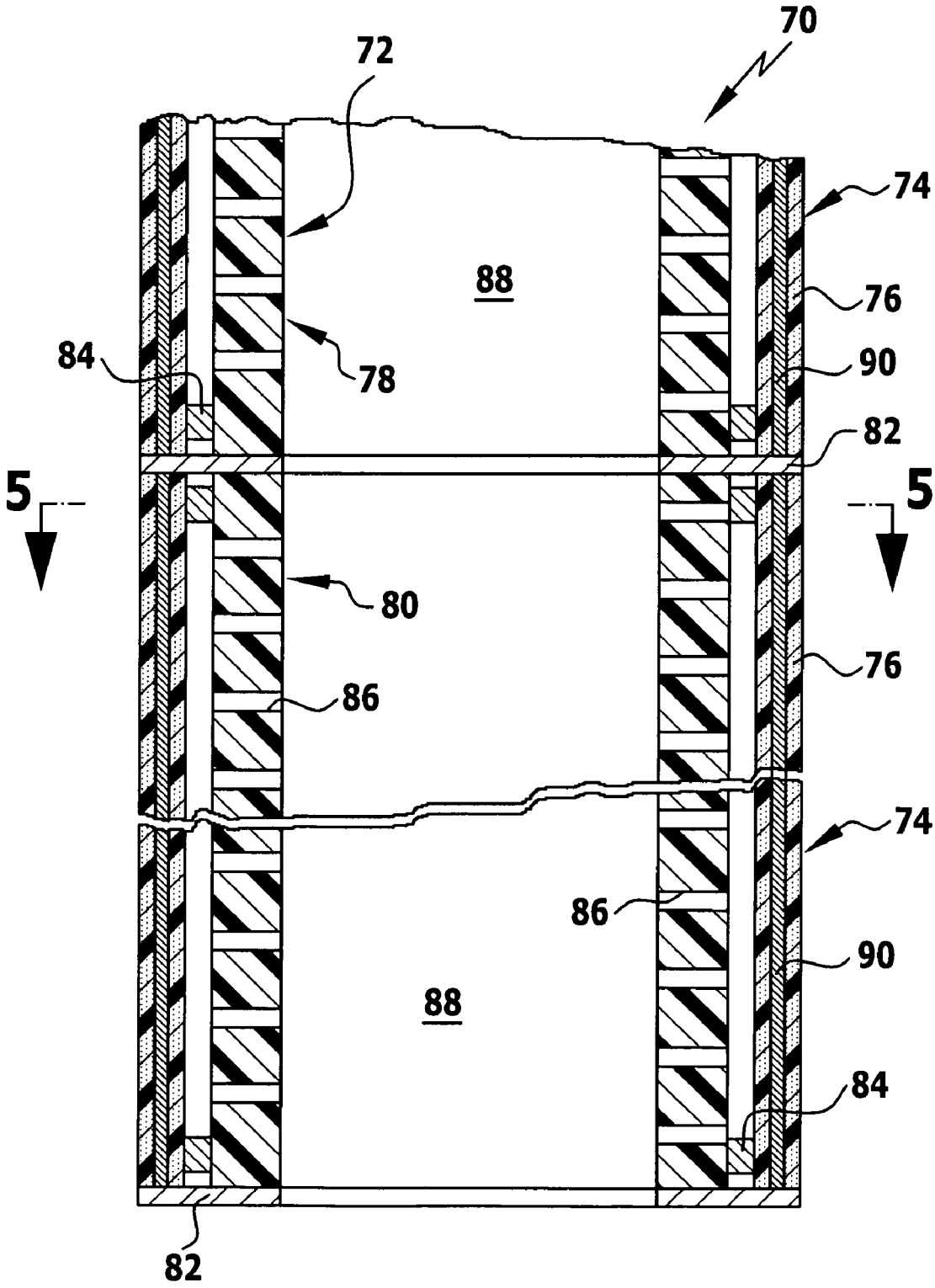
FIG. 4: a cross sectional representation of a further embodiment of an inventive filtering device.
Figure 5:
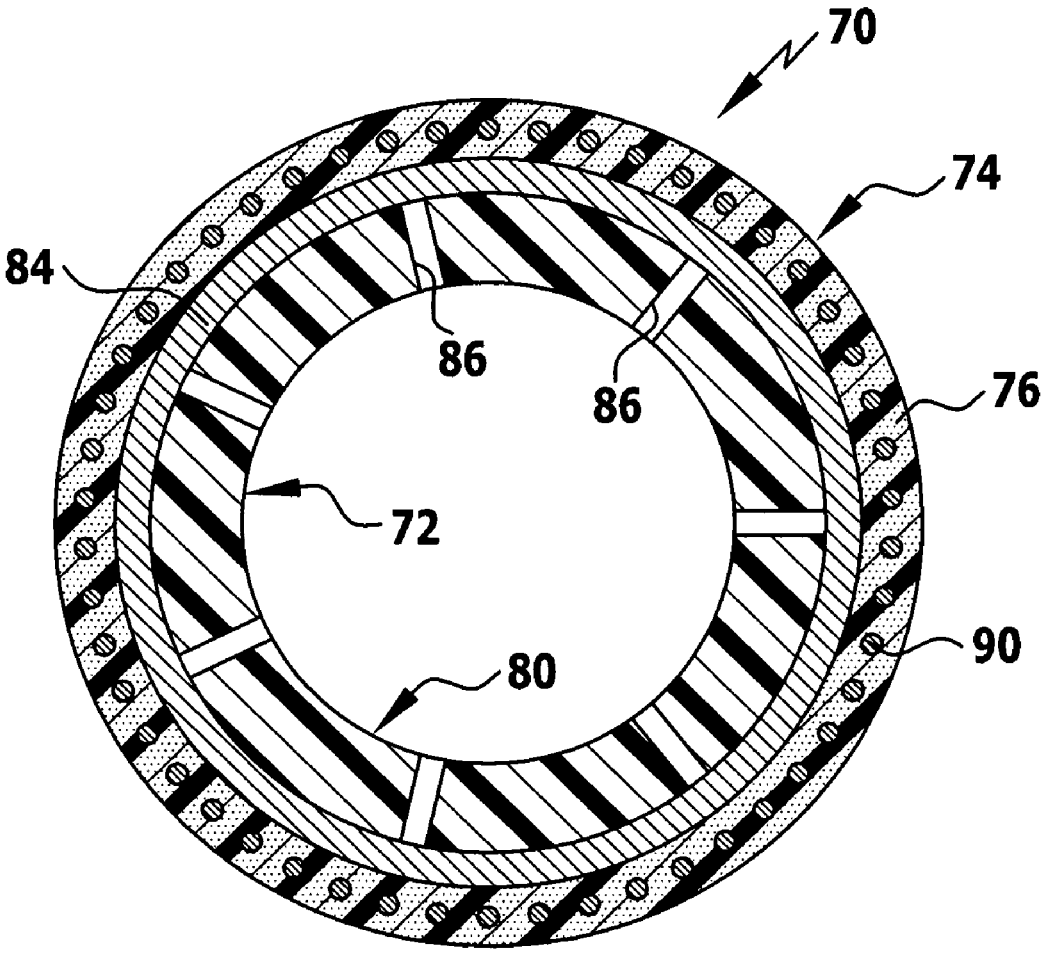
FIG. 5: a cross-sectional representation of the filtering device of FIG. 4 along lines 5-5.

FIGS. 4 and 5 show a longitudinal and a radial cross section of a further embodiment of the inventing filtering device 70 of the present invention.

The structure of the filtering device 70 is similar to the structure of the filtering device 40 and is essentially composed of a supporting element 72 which carries on its outer peripheral surface tubular porous segments 72 of a filter medium 76. The supporting element 72 is composed of a plurality of portions 78 and 80 which are bonded to one another by way of ring-shaped elements 82. The ring-shaped elements 82 serve like the ring-shaped elements in the embodiment of FIGS. 2 and 3 for sealing the end portions of the tubular segments 74 to the supporting element 72 in a fluid tight manner.

The distance between the outer circumferential surface of supporting element 72 with its portions 78 and 80 and the inner circumferential surface of the tubular segments 74 is defined by spacer rings 84.

Perforations 86 provided in portions 78 and 80 provide an essential unhindered fluid communication between the inner circumferential surface of the tubular segments 74 and an inner volume 88 of the filtering device 70 within portions 78 and 80. While in the embodiment of FIGS. 2 and 3 the filtering device 40 shows a tensile strength which is mainly provided by supporting element 42 in case of the filtering device 70 of FIGS. 4 and 5, the tubular segments 74 are also designed to provide a substantial portion of the tensile strength of the filtering device 70.

By doing so, the whole of the filtering device 70 can be provided with a substantial higher tensile strength than the filtering device 40 even if identical materials are used for manufacturing of the same and also the wall thicknesses of the supporting element 42/supporting element 72 and the tubular segments 44 and 74, respectively, remain the same.

Also in this embodiment, the tubular segments 74 of filter medium 76 may be manufactured from a number of tubular portions of filter medium as has been described in connection with the tubular segments 44 of the embodiment of FIGS. 2 and 3.

The measure taken in the embodiment of FIGS. 4 and 5 in order to achieve an extraordinary tensile strength is to include tie rods 90 in the tubular wall of filter medium of tubular segments 74 which extend over the whole axial length of the tubular segments and which are preferably fixed with the end portions in the ring-shaped elements 82.

The tie rods 90 may be made of a reinforced plastic material, the plastic material may be the same as the plastic material used for manufacturing the porous filter medium 76.

Likewise, the tie rods 90 may be bonded to the surrounding filter medium 76 or may be loosely inserted in bore holes therein, depending on the specific nature of the tie rods and the surrounding material which makes up for the filter medium and/or the desired effect of the tie rods 90.

It is easily conceivable that the tie rods 90 may be replaced by tie ropes.

It is easily understood that in all of the embodiments shown in FIGS. 1 through 5, i.e., the filtering devices 10, 40 and 70, respectively, may be designed such that their supporting elements 12, 42 and 72, respectively, form an outer peripheral surface for the filtering devices 10, 40 and 70, respectively.

Then the tubular segments 14, 44, 74, respectively, are positioned within the inner volume 38, 58, 88, respectively, of the filtering devices 10, 40 and 70, respectively.

In such a case, the supporting elements 12, 42 and 72, respectively, provide in addition to their supporting function a protecting function against mechanical impact in radial directions for the filter medium used.

Figure 6:
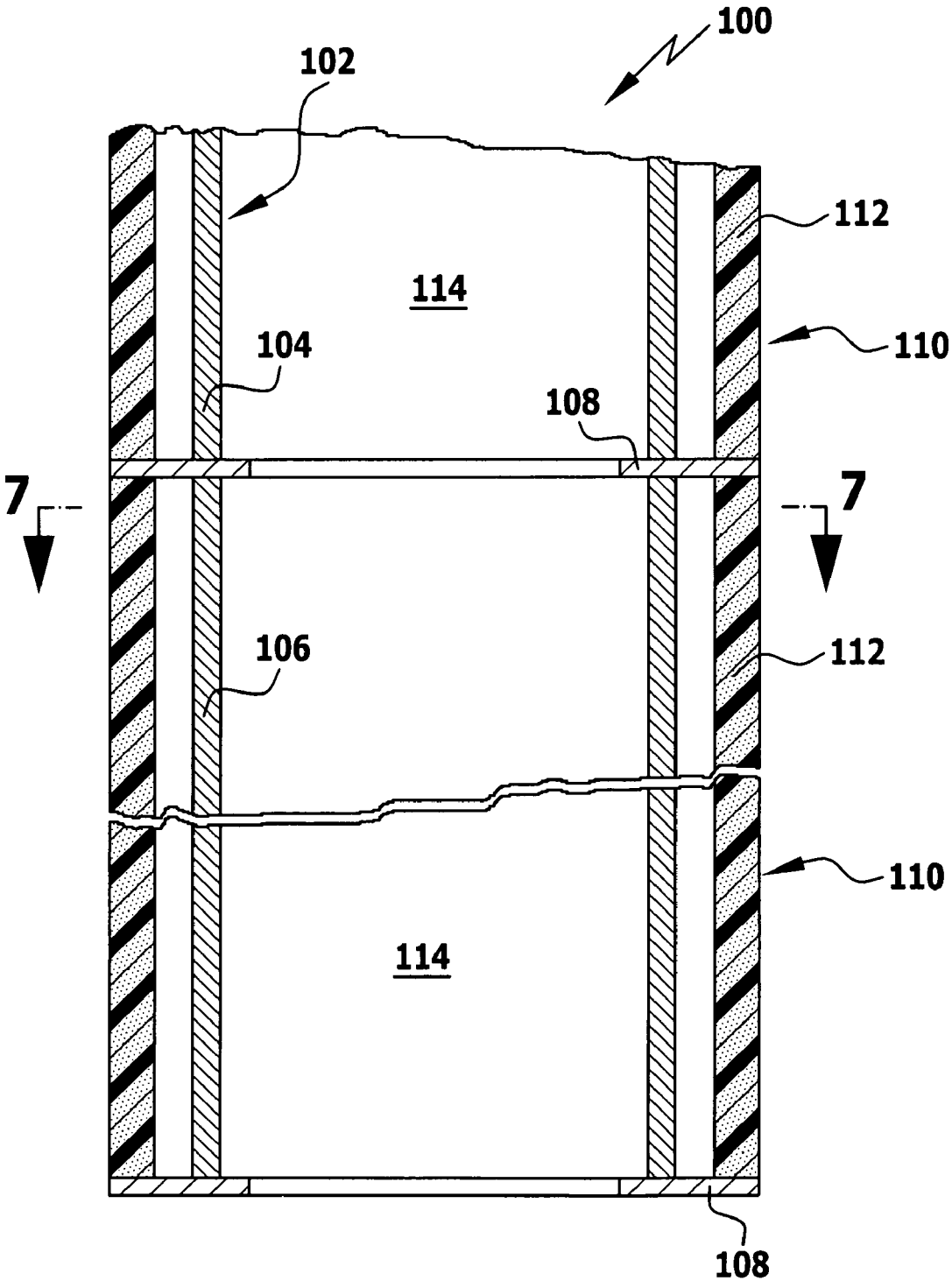
FIG. 6: a further embodiment of an inventive filtering device.
Figure 7:
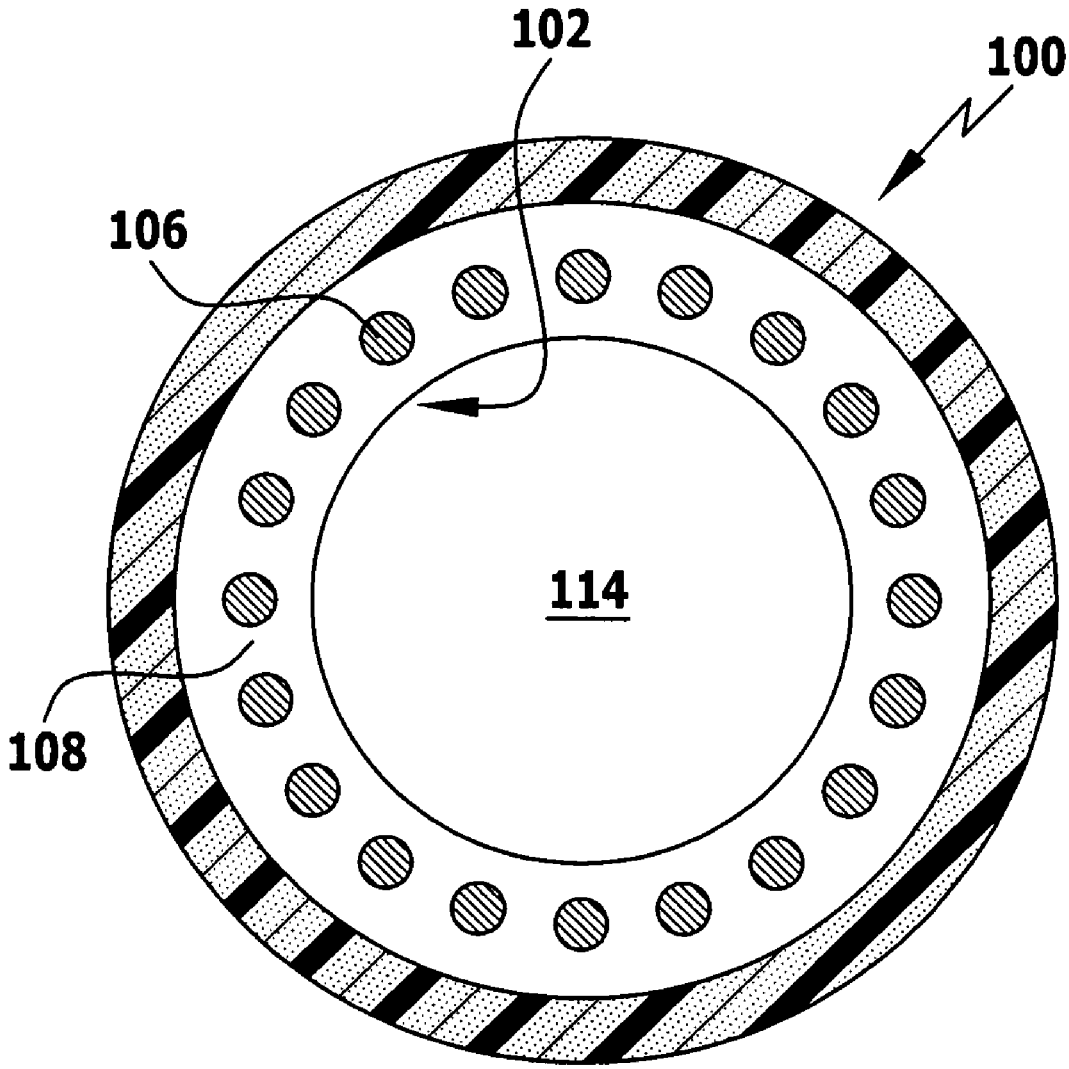
FIG. 7: a cross-sectional representation of the filtering device of FIG. 6 along lines 7-7.
Figure 8:
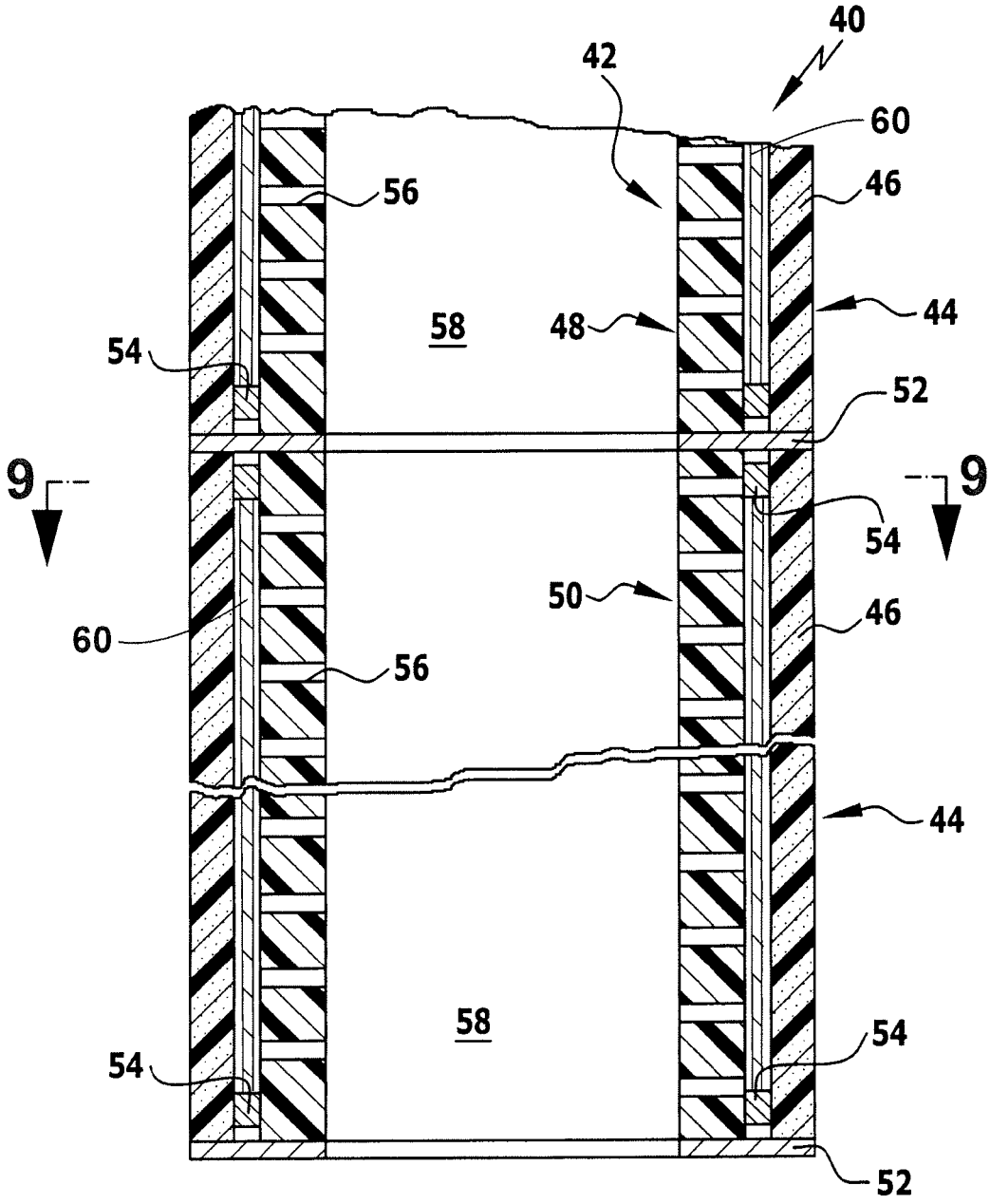
FIG. 8: A detailed cross sectional representation of an embodiment of the invention including the tie rods or tie ropes in between the tubular supporting element and the filter medium.
Figure 9:
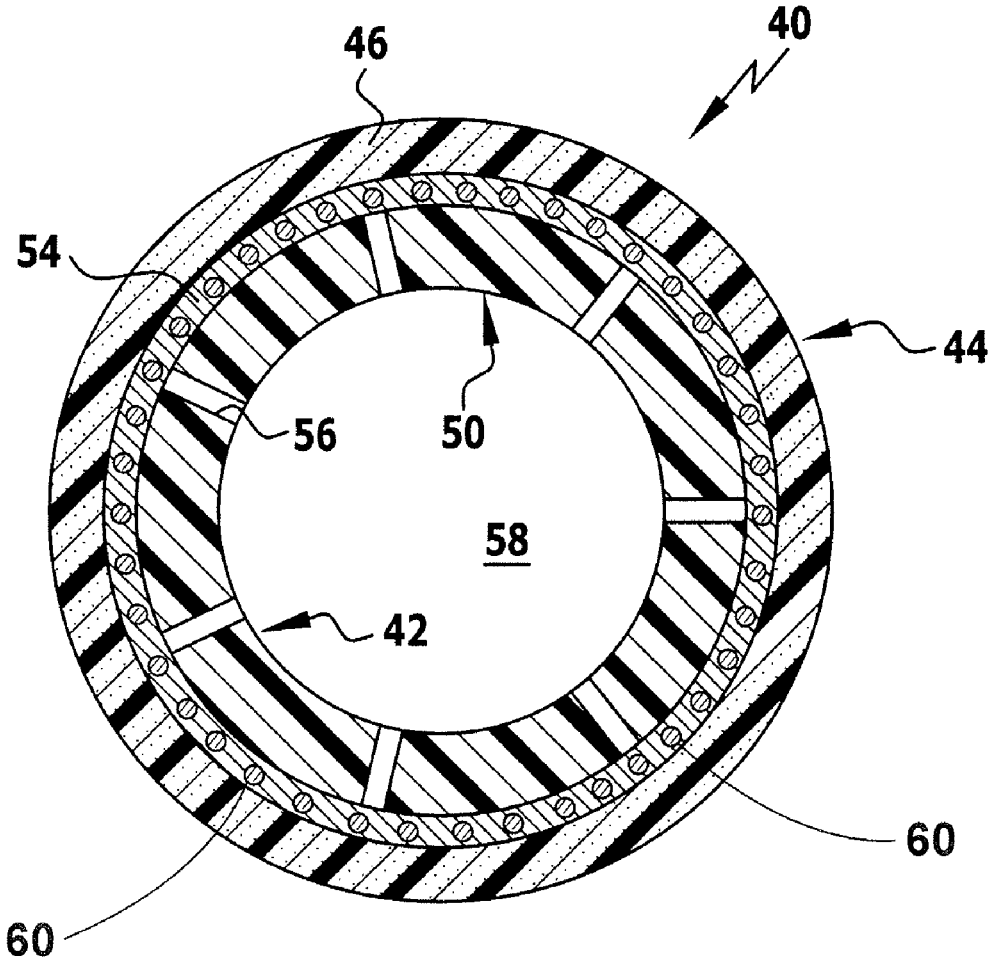
FIG. 9: a detailed cross sectional representation of the filtering device of FIG. 8 along lines 9-9.
Figure 10:
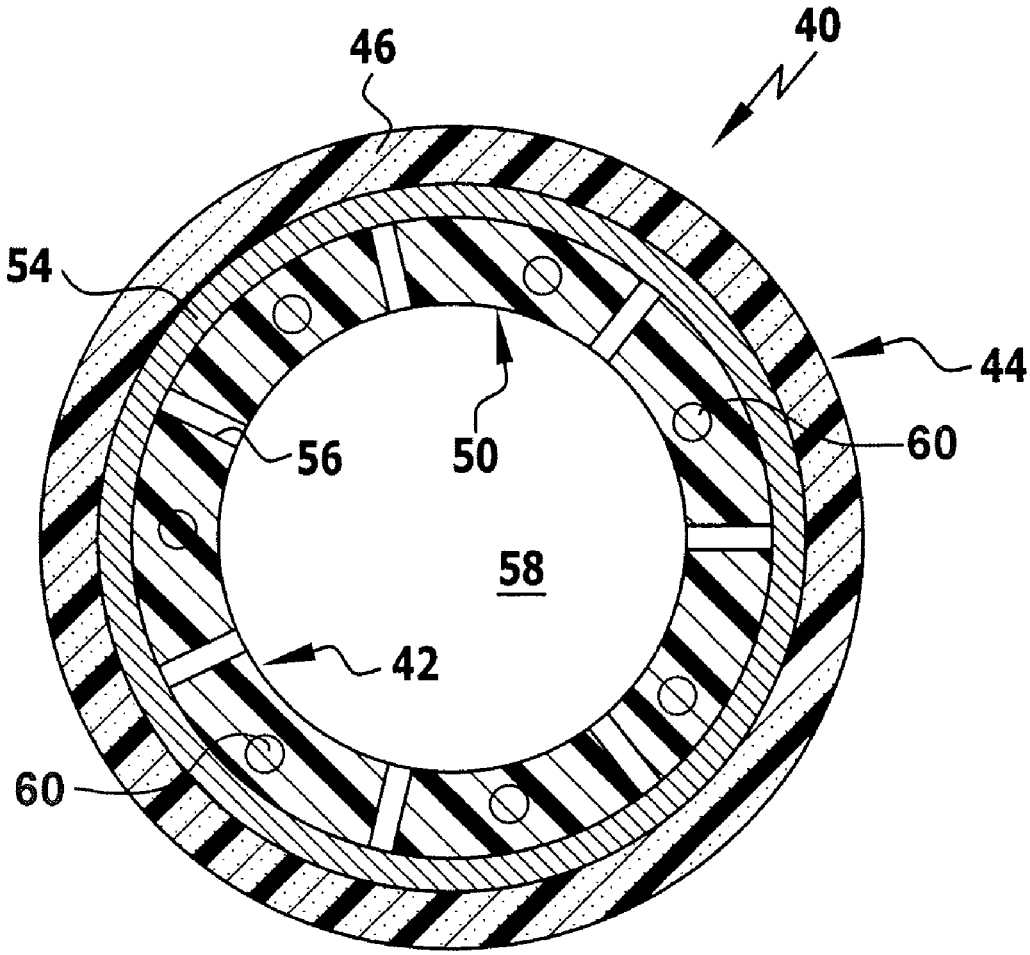
FIG. 10: a radial cross sectional representation of another embodiment of a filtering device including tie rods or tie ropes in the tubular wall of the supporting element.

FIGS. 6 and 7 show a somewhat different constructional principle for the inventive device in form of filtering device 100.

Filtering device 100 comprises a supporting element 102 which is essentially comprised of a cage-like arrangement of tie rods 104, 106 which are anchored in ring-shaped elements 104 which thereby serve for bonding portions of supporting element 102 together in lengthwise direction.

The outer peripheral surface of filtering device 100 is formed by tubular porous segments 110 of a filter medium 112. Again the tubular segments 110 are bonded to the ring-shaped elements 108 which form part of the supporting element 102. As described in connection with previous embodiments already, the porous tubular segments 110 may be made from a number of tubular filter medium portions.

The distance in between neighboring tie rods 106 ensures that practically unhindered fluid communication is provided between the inner peripheral surface of the tubular segments 110 and the inner volume 114 of the filtering device 100. Where, e.g., circular cross sectioned tie rods 104 and 106 are used as shown in the embodiment of FIGS. 6 and 7, it is easily conceivable that the tie rods 104 and 106 need not be positioned at a distance to the inner peripheral surface of the filter medium 112 of tubular segments 110 but may be positioned as close to the filter medium 112 as to contact the filter medium 112 on their outer peripheral surface. Still practically unhindered fluid communication between the inner volume 114 and the inner peripheral surface of the filter medium 112 will be provided.

The foregoing description of various embodiments of the present invention demonstrates quite clearly that the present invention advantageously allows to produce filter devices of very substantial length, i.e., up to several kilometers or even more, with a very limited number of different standard constructional elements. In addition, the present invention allows the use of standard raw materials to manufacture the various components of the filtering device, especially polyethylene material, in particular HDPE, which has its long standing merits in well bore applications serving for the production of drinking water and the like.

The mechanical properties necessary for handling, transporting and positioning of the inventive filter device can easily be provided including the necessary high tensile strength without the use of a casing which would have to be removed to make the filtering device operable.

A typical application using the inventive filtering devices is a seawater intake via a horizontal well bore. Such well bores are typically produced starting from the beach on the seaside and follows in several meters depth in an essentially horizontal fashion of, for example, 300 m length the underground level of the sea. The end of the bore will exit the underground of the sea and provide an opening in the underground of the sea where the filtering device can be connected to the drilling head and be drawn into the well bore during retraction of the drilling head. A typical configuration would include, e.g., a hundred meter non-porous tube on each side of the filtering device and a filtering device of 100 m.

The filtering devices are usually prefabricated in portions of a certain length, e.g., 12 m, which may be easily handled and transported to the drilling site. There, the individual portions of the filtering device will be assembled usually be welding these portions together. In order to handle the filtering device safely during positioning of the same in the bore hole, a tensile strength of the filtering device of ca. 20 metric tons must be provided.

As has been explained before, this provides for an extraordinary challenge for a filtering device with an outer diameter of approximately 355 mm and an inner diameter of 235 mm (inner volume).

Typical wall thicknesses of the filter medium used in such devices are 20 mm which provide for a sufficient pressure resistance under typical operation conditions of the filtering device. The tensile strength of a porous sintered HDPE filter medium of particles of an average particle size of ca. 600 μm and a porosity of ca. 200 μM amounts to approximately 1 metric ton.

The tensile strength of the filtering material therefore would by far not be sufficient for the filtering device to be safely handled and positioned within the bore hole.

Therefore, the supporting element of a HDPE material, which may be designed as described above and having a wall thickness of ca. 23 mm, essentially provides the tensile strength needed such that the filter medium may be designed for optimum filtering results. A typical distance between the supporting element and the filter medium positioned on its outer surface is ca. 15 mm.

The weight of the afore-defined exemplary filtering device amounts to approximately 50 kg/m.

The invention claimed is:

1. A filtering device, especially for use as a well screen filter, comprising a tubular supporting element comprising plastic material and two or more tubular segments of a porous filter medium comprising plastic material arranged in axial alignment to one another and concentrically and essentially coextensive with the tubular supporting element, said tubular supporting element having a tubular wall provided with a plurality of perforations and having a plurality of projections projecting from said tubular wall, said projections supporting and bonded or welded to the two or more tubular segments in axial alignment with the tubular wall, said tubular segments each having two end portions which are in sealing contact with and are bonded or welded to the tubular supporting element or an end portion of another tubular segment.

2. The filtering device of claim 1, wherein the filter medium has a pore size of 5 μm or more.

3. The filtering device of claim 1, wherein the tubular segments of porous filter medium comprise a porous tubular wall of sintered particulate plastic polymer material.

4. The filtering device of claim 3, wherein the plastic polymer material is a polyethylene material.

5. The filtering device of claim 1, wherein the tubular wall of the supporting element is made from a non-porous plastic material.

6. The filtering device of claim 5, wherein the non-porous plastic material is a polyethylene material.

7. The filtering device of claim 1, wherein the tubular supporting element is positioned within the porous tubular segments.

8. The filtering device of claim 1, wherein the tubular supporting element comprises ring-shaped elements providing the projections.

9. The filtering device of claim 8, wherein the ring-shaped elements provide a predetermined distance between the tubular wall and the filter medium.

10. The filtering device of claim 8, wherein the tubular supporting element and the porous tubular segments are connected to one another by first and second ring-shaped elements arranged adjacent to the respective ends of the porous tubular segments.

11. The filtering device of claim 10, wherein the first and second ring-shaped elements radially extend beyond the surface of the tubular segments.

12. The filtering device of claim 8, wherein one or more spacers are arranged between the tubular wall and the filter medium in an axial position between the first and the second ring-shaped elements.

13. The filtering device of claim 8, wherein the first and second ring-shaped elements comprise a weld seam.

14. The filtering device of claim 1, wherein the tubular segments comprise two or more portions of tubular porous filter medium bound together to form an individual tubular segment.

15. The filtering device of claim 1, wherein the filtering device comprises a plurality of tie rods or tie ropes, positioned remote from the axis of the filtering device in predefined distances to one another and parallel to the axial direction of the filtering device.

16. The filtering device of claim 15, wherein the tubular filter medium includes a porous cylindrical wall and the tie rods or tie ropes are accommodated within the porous cylindrical wall.

17. The filtering device of claim 15, wherein the tie rods or tie ropes are accommodated in between the tubular supporting element and the filter medium.

18. The filtering device of claim 15, wherein the tie rod or tie ropes are accommodated in the tubular wall of the supporting element.

19. The filtering device of claim 1, wherein the tubular supporting element comprises a number of portions welded together.

20. A method of filtering seawater, comprising passing the seawater through the filtering device of claim 1.

* * * * *